US005917446A

United States Patent [19]

Greenspan

[11] Patent Number: 5,917,446

[45] **Date of Patent: *Jun. 29, 1999**

[54] RADIO-WAVE RECEPTION SYSTEM USING INERTIAL DATA IN THE RECEIVER BEAMFORMING OPERATION

[75] Inventor: Richard L. Greenspan, Newtown, Mass.

[73] Assignee: The Charles Stark Draper Laboratory, Inc., Cambridge, Mass.

[ * ] Notice:

This patent issued on a continued prosecution application filed under 37 CFR 1.53(d), and is subject to the twenty year patent term provisions of 35 U.S.C. 154(a)(2).

[21] Appl. No.: 08/555,172

[22] Filed: Nov. 8, 1995

[51] Int. Cl.[6] ..... H01Q 3/22; H01Q 3/24; H01Q 3/26

[52] U.S. Cl. ..... 342/373; 342/357

[58] Field of Search ..... 342/357, 457, 342/373, 157, 158; 364/449.7

[56] References Cited

U.S. PATENT DOCUMENTS 5,416,712 5/1995 Geier et al. ..... 364/450
5,534,875 7/1996 Diefes et al. ..... 342/357

OTHER PUBLICATIONS

Van Veen, et al (Apr. 1988) "Beamforming: A Versatile Approach to Spatial Filtering," *IEEE ASSP Magazine,* pp. 4–24.

*Primary Examiner*—Theodore M. Blum
*Attorney, Agent, or Firm*—Lappin & Kusmer LLP

[57] ABSTRACT

A receiver system on a mobile host vehicle platform includes an inertial sensor embedded in an antenna groundplane that supports an array of antenna elements. The beamformer within the receiver system determines the beamforming weights by incorporating inertially-generated signals representative of the attitude of the receiver system and location data identifying the location of GPS satellites. As the host vehicle moves, the beamformer generates the appropriate gain pattern based on the inertial data of the current attitude and the GPS location data. The beamformer, in particular, performs a spatial filtering function that is characterized by high-gain profiles in the direction of transmission of selected ones of the GPS terminals, thereby effectively suppressing signals originating from jammers and other sources of RFI.

26 Claims, 3 Drawing Sheets

RADIO-WAVE RECEPTION SYSTEM USING INERTIAL DATA IN THE RECEIVER BEAMFORMING OPERATION

FIELD OF THE INVENTION

The present invention relates to radio-wave communication and navigation systems and, more particularly, to the reception of broadcast transmissions in the presence of interference.

BACKGROUND OF THE INVENTION

Radio-wave communication and navigation systems that receive signals corrupted by distributed sources of radio frequency interference (RFI) require a facility for discriminating between the desired signals and the RFI. These desired signals may be provided by a network of orbiting satellite transmitters such as the Global Positioning Satellite (GPS) system or by any terrestrial, airborne or orbiting radio frequency (RF) source(s). In particular, a fundamental liability of using the GPS system for navigational purposes is the vulnerability of GPS signals to intentional or unintentional RFI or other jamming sources. RFI that occupies frequencies outside the GPS signal band can be suppressed by filtering within the GPS receiver, whereas suppression of inband RFI requires more elaborate techniques. Accordingly, the need exists to provide an improved system for spatially discriminating against in-band RFI that emanates from directions other than the line-of-sight propagation paths from a GPS receiver to the GPS satellites, or more generally from the signal receiver to the signal source(s).

A steerable antenna array is one spatially discriminatory receiver system that is suitable for deployment in jamming environments. Ideally, the array will perform a beamforming operation that can provide gain in a desired direction (i.e., toward the GPS satellites) and attenuation of signals arriving from undesired directions (i.e., toward sources of jamming power). The beamforming operation generally involves multiplying the output from each antenna array element with a complex beam weight and then applying these weighted signals to a summing device that linearly combines the signals. The response of the beamformer is tailored to the desired reception profile by appropriately selecting the beam weights.

The most widely used RFI suppression antenna for GPS applications uses a sub-optimum mechanization in the form of a null-steering antenna array. This array is characterized by an antenna gain pattern having nulls in the direction of transmission of jammers or other sources of RFI, thus providing a form of spatial discrimination.

Despite their apparent ability to suppress RFI, null-steering antenna arrays experience a variety of operational difficulties that make them unsuited for deployment in certain signal reception environments. For example, in distributed jamming scenarios such as those in military environments, the number of individual jammer sources may well exceed the maximum number of nulls that can be formed (e.g., typically one less than the number of antenna array elements), thereby significantly reducing the ability of the receiver to suppress interference. GPS antenna arrays installed on military aircraft, for example, are typically limited by size constraints to seven antenna elements, for which one can independently suppress jamming radiation that arrives from only six directions. This limitation on the available number of antenna elements (and hence the number of nulls) is principally due to the increased degree of antenna complexity (i.e., hardware and physical installation) that accompanies each additional antenna element. A need therefore exists to develop a receiver system that is insensitive to the number and distribution of jammers.

Additionally, the deployment of null-steering configurations under certain operating conditions can cause the receiver system to experience an extended, and sometimes complete, interruption of communication services. For example, when the line-of-sight of propagation between a satellite and vehicle lies within a null profile, the null profile will not only suppress the particular RFI source(s) for which it was specifically developed, but will effectively cancel any GPS transmission from this satellite. Under these circumstances, a contingency plan may be invoked wherein the GPS receiver is forced to switch to an alternate satellite. However, this satellite switching results in a corresponding loss of service during the acquisition period for the new satellite, and is likely to cause degraded service thereafter.

In operating conditions featuring unknown or time-varying statistics for the data and/or interference signals, receiver systems have difficulty in continuously acquiring and tracking the desired signal transmissions. In order to provide a beamforming operation suitable for such conditions, null-steering arrays have been modified to incorporate an adaptive algorithm that dynamically calculates the beamforming weights so that the beamformer response converges to a statistically optimum nulling solution.

In this adaptive array configuration, the outputs of auxiliary antenna elements are weighted and combined with the output of a primary antenna element to minimize the total received signal power through the appropriate selection of the beamforming weights. The underlying premise of this adaptive scheme is that the desired signal (e.g., GPS information) is weak with respect to interference; otherwise, the jammer would be ineffective. Therefore, by minimizing input power, the signal level of the interference sources is minimized. This minimization has the effect of forming "nulls" in the antenna gain pattern direction to the strongest interference source(s). The combining (i.e., beamforming) weights are continuously adjusted to account for relative motion of the vehicle with respect to the signal sources, such that the nulls remain aligned with the desired interference sources.

However, as a result of such minimization, the desired signal may be cancelled or significantly attenuated. This limitation appears in any type of GPS power minimizer and hence makes the adaptive array an inadequate device for achieving precise data acquisition.

Another feature of this adaptive approach is that multiple iterations of signal sampling and beam formation are typically required in order to converge upon the optimum null-steering weights. Although non-iterative techniques have been used to implement the statistically optimum beamformer, iterative solutions have received the most attention since a non-iterative approach relies upon making measurements of incoming signals that may not sufficiently converge within the time period (e.g., tens of milliseconds) typically necessary to adequately track the signal.

The iterative adaptive algorithm has been shown to be successful in achieving signal lock during stationary operation; however, its effectiveness is reduced by motion of the vehicle platform (especially rotational) that houses the receiver system. For example, with approximately 10 ms being necessary to converge to the desired pattern (a property that appears in virtually all existing antenna implementations), there is insufficient time available for the adaptive algorithm to properly form nulls when the vehicle platform is continuously turning. In particular, the adaptive algorithm cannot adjust the beamforming weights fast enough to accommodate rapid changes in the attitude of the host vehicle.

Furthermore, with intelligent jamming such as blinking jammers, the algorithm must develop nulling profiles for a jammer network whose spatial distribution is constantly changing. Accordingly, since an intelligent adversary will cause the distribution of blinking jammers to change at a rate faster than the convergence time of the null-forming algorithm, the dynamic nature of the jammer network prevents the algorithm from converging upon optimum beamforming weights and thereby renders the algorithm virtually ineffective.

OBJECTS OF THE INVENTION

It is a general object of the present invention to obviate the above-noted and other disadvantages of the prior art.

It is a specific object of the present invention to provide an antenna beamformer whose ability to selectively acquire transmissions from desired signal sources while effectively suppressing interference does not require a convergence procedure and is independent of any knowledge or identification of the interfering sources.

It is a further object of the present invention to provide a receiver system on a host vehicle platform that is capable of dynamically maintaining a beam(s) pointed in the direction (s) of one (or more) GPS satellite(s) regardless of changes in the attitude of the host vehicle.

It is a further object of the present invention to provide a receiver system that employs a beamformer whose operation is characterized by a spatial filtering function that incorporates data on the location of desired signal sources and information representative of the position and inertially-sensed attitude of the receiver system.

SUMMARY OF THE INVENTION

The present invention is directed to a system for receiving signals transmitted from a plurality of signal sources identified by source location data. The system includes a receiver for receiving energy propagations. An attitude determination subsystem determines the attitude of the receiver relative to the signal sources. A beamformer, coupled to the receiver and the attitude determination subsystem, processes the received energy in accordance with the source location data and the determined attitude of the receiver.

In one form of the system of the invention, the receiver includes an antenna array, and a support structure is provided for integrally supporting the antenna and the attitude determination subsystem.

In another form of the system of the invention, the beamformer includes a spatial filter subsystem for spatially filtering the received energy in accordance with a beamformer response having a gain profile defined by the source location data and the determined attitude of the receiver.

In another form of the system of the invention, the receiver comprises a plurality of antenna elements and the attitude determination subsystem includes an inertial sensor for generating signals representative of an inertially-sensed attitude of the receiver. In a preferred configuration, the antenna platform supports the plurality of antenna elements and the inertial sensor as an integral structure.

In another form of the system of the invention, the beamformer comprises an analyzer, responsive to the source location data and coupled to the attitude determination subsystem, for generating beam-weighting data that embodies a representation of the source location data and the determined attitude of the receiver. The beam-weighting data is suitable for weighting the energy received by the antenna elements. A beamformer coupled to the receiver is responsive to the beam-weighting data for combining the received energy using the beam-weighting data. A response of the beamformer is characterized substantially by a high-gain beam in each direction of transmission of ones of the signal sources.

The receiver may be equipped to receive electromagnetic energy (such as radiowave propagation) or acoustic energy, as in the reception of sonar signals.

In yet another form of the present invention, a system affixed to a mobile host vehicle, is provided for receiving transmissions from a plurality of signal sources. The system includes a subsystem for determining the location of the signal sources, an antenna for receiving energy transmissions, and an inertial sensor for inertially sensing the attitude of the mobile host vehicle. The system further includes a beam weighting subsystem for developing a beam-weighting factor set, based on the inertially-sensed attitude and the signal source locations, that defines a spatial filtering function. A beamformer is operably coupled to the antenna and the beam weighting subsystem for spatially filtering the transmissions received by the antenna in accordance with the beam weighting factor set. The spatial filtering function is characterized by high-gain profiles in the direction of transmission of selected ones of the signal sources whose transmissions were received by the antenna.

In one form of the system, the beamformer includes a combiner for linearly combining the transmissions received by the antenna in accordance with the beam weighting factor set.

In another form of the system, the inertial sensor includes a micromechanical inertial sensor and read-out electronics integrally embedded in an antenna groundplane that supports the antenna.

In yet another form of the system, the beam weighting subsystem includes a database including data representative of a plurality of host vehicle attitude values, each indexed to a corresponding beam weighting factor set. An access and retrieval controller coupled to the database is responsive to the inertially sensed attitude for providing the beam weighting factor set from the database corresponding to the inertially sensed attitude.

In another form of the system, a navigation subsystem is provided for continually calibrating the inertial sensor to compensate for drift errors.

BRIEF DESCRIPTION OF THE DRAWINGS

Throughout the drawings the same or similar components are identified by the same reference numeral.

DETAILED DESCRIPTION OF THE PREFERRED EMBODIMENTS

The present invention is directed to an antenna-based receiver system that employs a novel beamforming operation whose means for determining beamforming weights is responsive to inertially-generated signals representative of the attitude of the receiver system and to location data identifying the location of desired signal sources (e.g., GPS satellites). By incorporating this information into the determination of the beamforming weights, the beamforming operation is adapted to respond to changes in the transmission environment as the receiver system moves. The beamformer, in particular, performs a spatial filtering function that is characterized by high-gain profiles in the direction of transmission of selected ones of the GPS satellites and low gain in the other directions of the coverage area, thereby effectively suppressing signals originating from jammers and other sources of RFI arriving from those other directions.

Figure 1:
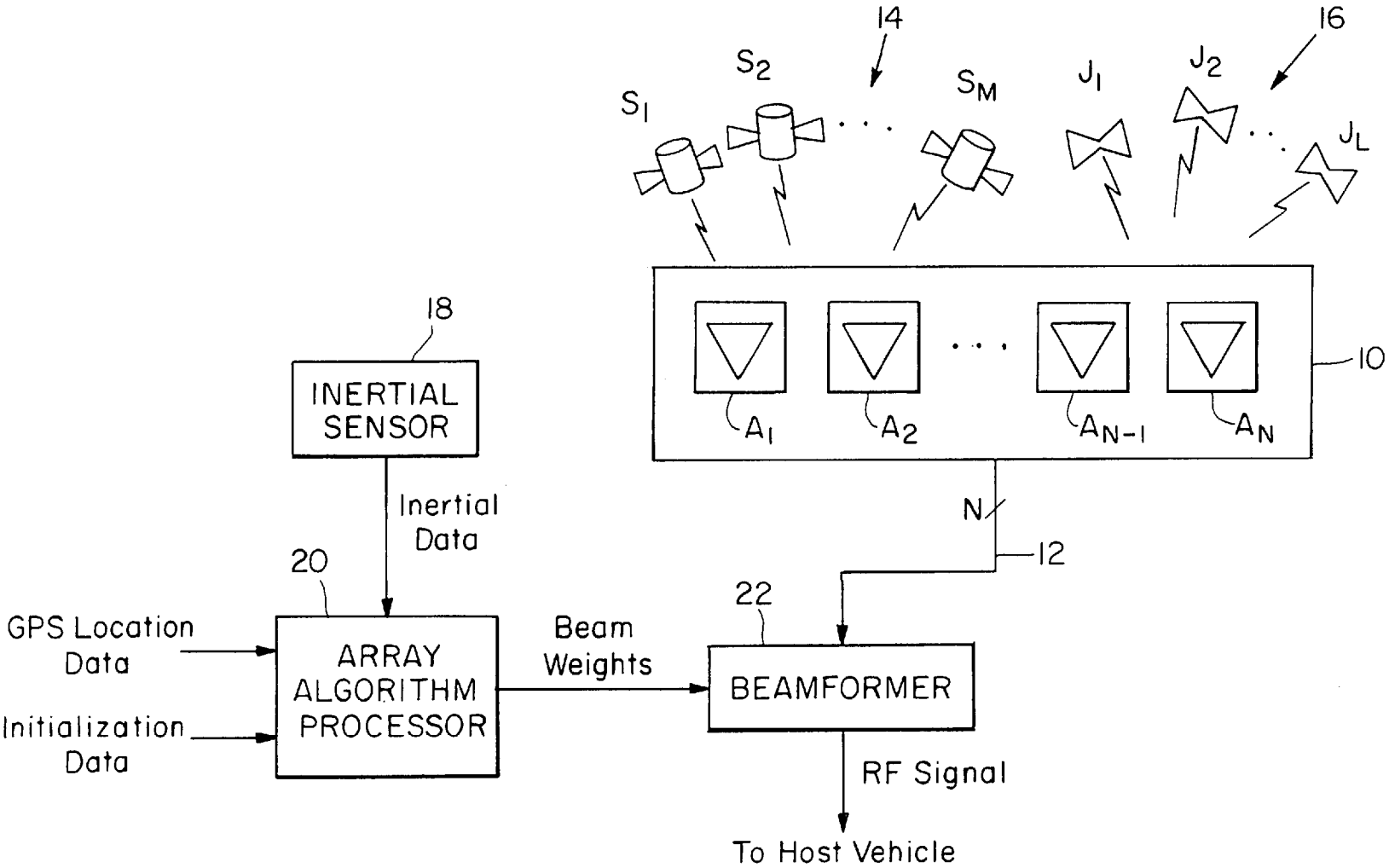
FIG. 1 is a system block diagram of a receiver system in accordance with a preferred embodiment of the present invention.

FIG. 1 is a system block diagram of a receiver system in accordance with a preferred embodiment of the present invention. The system includes an array 10 of individual antenna elements $A_i$ (i=1 to N) for receiving electromagnetic energy propagating within a defined coverage area as determined by the gain patterns of the respective antenna elements. The received energy from antenna array 10 is provided on multiplexed channel 12. For illustrative purposes, the coverage area is shown to include a GPS system 14 with individual satellites $S_k$ (k=1 to M) and an interference network 16 of RFI sources $J_r$ (r=1 to L). It is one object of the present invention to selectively acquire transmissions from the desired signal sources (i.e., GPS system 14) while suppressing the signals from RFI network 16 through adequate signal attenuation.

The configuration for antenna array 10 depicted in FIG. 1 is shown for illustrative purposes only, as it should be apparent to those skilled in the art that any number of antenna arrangements can be used. Furthermore, the antenna elements are not limited to any specific coverage profile, although each antenna element preferably provides hemispherial coverage. The degree of directionality of the beams in the beamformer response depends upon the physical size of the antenna array. Accordingly, the dimensions of the antenna may be chosen to achieve a certain directionality characteristic.

The receiver system further includes an inertial sensor 18 for generating inertial data that is representative of the attitude of antenna array 10. The inertial sensor 18 includes an appropriate measurement facility for measuring the attitude of antenna array 10. Since the indicated subsystems are preferably located on a mobile host vehicle platform, the inertial data also indicates the attitude of the host vehicle platform. In a preferred arrangement, inertial sensor 18 is integrally embedded into an antenna groundplane (not shown) that physically supports antenna array 10. For example, inertial sensor 18 is monolithically integrated with the antenna array elements on a common substrate platform. This arrangement may take advantage of emerging packaging technology that offers miniaturized antenna array elements. Additionally, the integral structure would preferably include an electronic output device for assembling the inertial data generated by inertial sensor 18 and forwarding this data to an appropriate processing facility, e.g., array algorithm processor 20 (discussed below).

A beamforming apparatus is provided that includes an array algorithm processor 20 and a beamformer 22. In general, beamformer 22 is operative to combine the received energy provided by antenna array 10 in accordance with a beam-weighting factor set comprised of constituent beam weights that are generated by array algorithm processor 20. As will become apparent hereinafter, beamformer 22 is designed to reject transmissions from jammers and other interference sources by processing the received energy in accordance with a beamformer response that controllably and dynamically develops high-gain profiles in only the directions of transmission of the GPS satellites.

The receiver system is not limited to operation within the indicated GPS system, but may be deployed in any communications environment having any configuration or type of signal sources. Additionally, the receiver system described herein is not limited to the processing of any particular signal type or polarization. Rather, the beamformer may operate upon radio wave propagation (i.e., transverse electromagnetic waves) as well as acoustic signals (compressional, i.e., longitudinal waves), as in the reception of sonar energy. Additionally, the signal energy may represent analog or digital information. The beamforming operation is also not limited to any particular transmission format or bandwidth, as it should be apparent to those skilled in the art that the incoming radiation may occupy any portion of the bandwidth detectable by the antenna array, and may be transmitted in any format (e.g., frequency or amplitude modulation, packetized bursts).

By way of background, a beamformer is a processor used in conjunction with an array of sensors (e.g., antenna array elements) to provide a form of spatial filtering. Although applicable to either the reception or radiation of energy, beamforming as used herein will refer to the signal processing that is performed on the received energy provided by the antenna elements of array 10. The specific characteristics of the signal processing are determined by the beamformer response, which is generally defined as the amplitude and phase presented to a complex plane wave as a function of location and frequency. This plane wave would correspond to the spectral energy received by antenna array 10 from any one of the GPS satellites. As a generalized definition, the beamforming operation directed to the reception of any one signal may be expressed as a linear combination of the data (i.e., received signal voltage) provided by antenna array 10, as scaled (i.e., multiplied) by the dynamically adjustable beamforming weights. The specific form of the beamformer response depends upon the particular selection of these beamforming weights. In particular, the spatial directivity of the beamformer response is directly influenced by the weights. A general discussion of beamforming may be found in "Beamforming: A Versatile Approach to Spatial Filtering", IEEE ASSP Magazine, pp. 4–24 (April 1988) by Van Veen et al., incorporated herein by reference.

In accordance with the present invention, the weights used by beamformer 22 are based on an inertially-sensed attitude of the host vehicle and location data that identifies the location of the individual satellites in GPS system 14. Referring specifically to FIG. 1, array algorithm processor 20 is responsive to GPS location data and to inertial data received from inertial sensor 18 for generating beam weights that are transferred to beamformer 22. Beamformer 22 performs a scaling operation, applying the weights to scale the received voltage from the respective elements of antenna array 10 and then combining the scaled (i.e., weighted) signals with a summing device. The array algorithm processor 20 also receives initialization data for initializing the attitude value in inertial sensor 18.

Figure 2:
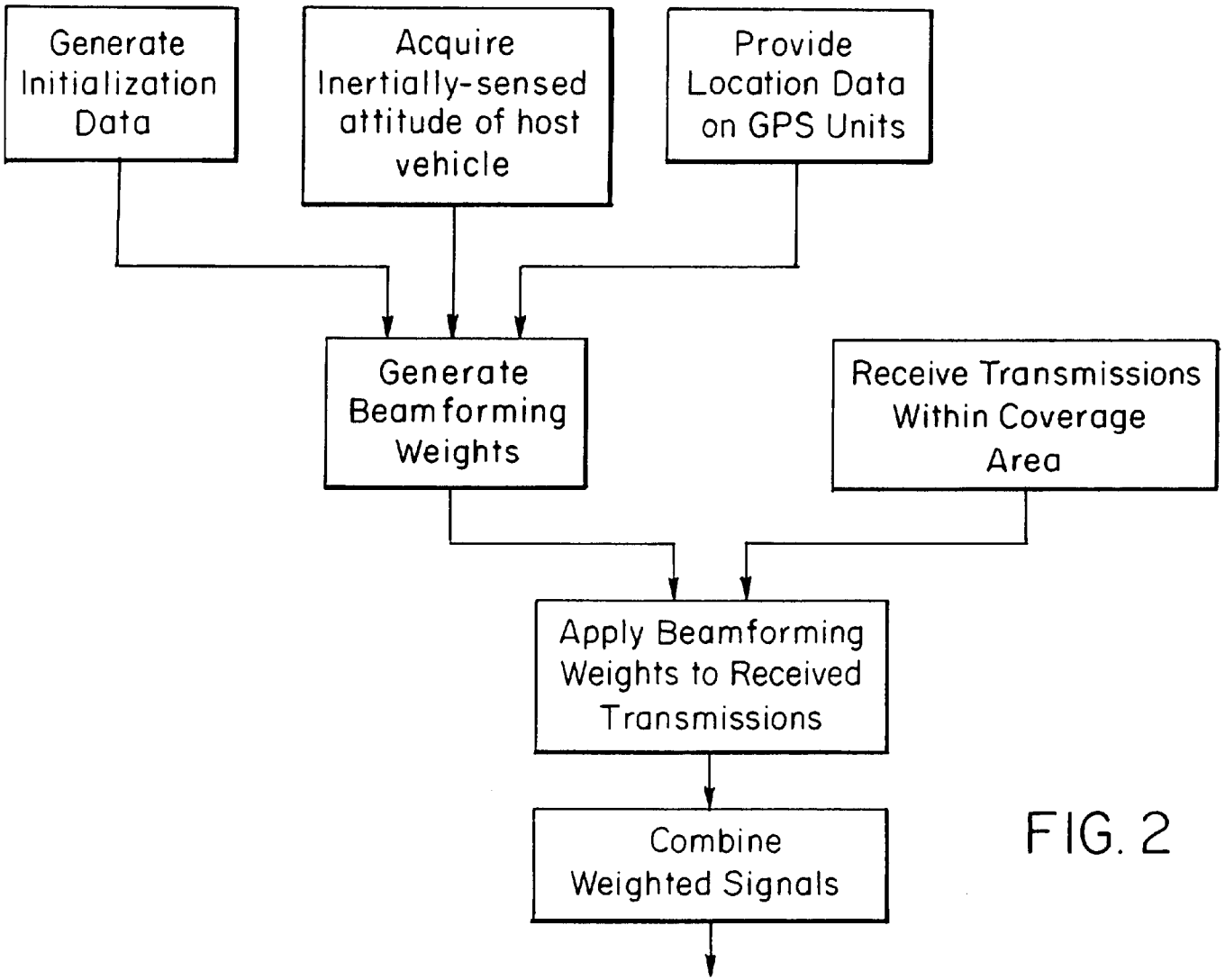
FIG. 2 is a flow diagram of a beamforming operation used by the present invention.

The operation of the receiver system shown in FIG. 1 may be understood with reference to the flow diagram of FIG. 2. The essential feature of the receiver system 10 involves the formulation of beamforming weights using source location data that identifies the location of desired signal sources (e.g., GPS units), and using inertial data that represents the inertially-sensed attitude of the antenna system (i.e., host vehicle). Since the beamforming weights ultimately determine the spatial filtering characteristics of the beamforming operation, the receiver system can be tailored via the appropriate selection of weights to receive transmissions from selected ones of the GPS satellites.

Referring to FIGS. 1 and 2, the attitude of the host vehicle is determined by inertial sensor 18 and takes the form of inertial data representative thereof. The inertial sensor is preferably constructed from a micromechanical inertial measurement unit that is integrally embedded into the antenna groundplane that supports antenna array 10. The inertial data is thus a precise measure of the location and attitude of the antenna array. This location may be specified in absolute terms or relative terms (i.e., measured with respect to a reference point).

The location of each desired signal source (within the same reference frame used by the inertial sensor) is provided to array algorithm processor 20 as GPS Location Data (for example, representative of the location of the GPS satellites relative to the reference point). Although the signal sources described herein correspond to the GPS system, the present invention may be deployed in any communications environment provided that data is available on the location of the signal sources and the user's location (i.e., the location of the host vehicle). For example, in an environment with mobile signal sources, the host vehicle may be configured with a communications link that continuously acquires current source location data from a ground station.

In accordance with one aspect of the present invention, the location and identity of the desired signal sources are predetermined. The facility for predetermining the source location data is not considered a part of the present invention, as it should be apparent to those skilled in the art that any suitable means may be used to ascertain the location of the known signal sources. Additionally, the source location data may be stored in a computer memory or other suitable storage device capable of ready access. In the case of GPS satellite tracking, for example, the satellite locations may be embodied in a GPS message that is transferred to the receiver system over a data bus connected to the host vehicle, thereby facilitating the receipt of continuously updatable location information which reflects any change in position of the GPS satellites. The signal sources, for example, may also be fixed (i.e., immobile) in known locations.

The inertially-sensed attitude and GPS Location Data together provide an indication of which signal sources the antenna array 10 is "viewing" within its coverage area. In particular, this information identifies those signal sources (i.e., GPS satellites) whose transmissions are propagating within the current coverage area (and consequently will be received by antenna array 10), and includes data indicating the directions from the antenna array to the signal sources. After these inputs to array algorithm processor 20 have been provided, the GPS Location Data and inertially-sensed attitude are used to generate a sequence of beamforming weights, as discussed below in greater detail.

The beamforming weights influence the spatial filtering characteristics of the beamformer, namely by determining how the beamformer response will discriminate among transmissions as a function of their point of origin. In accordance with the present invention, the specific character of this spatial discrimination depends upon the source location data and inertially-sensed attitude that are used to formulate the beamforming weights. In particular, the weights are appropriately generated to embody a representation of the source location data and inertially-sensed attitude, such that the resulting beamformer response will be characterized by high-gain profiles in the direction of transmission of the signal sources. If every signal source transmitting within the current coverage area is not to be tracked, the array algorithm may be supplied with an indication of only selected ones of these signal sources desired for reception.

In accordance with one aspect of the present invention, the array algorithm processor may incorporate a database including data representative of a plurality of host vehicle attitude values, each indexed to a corresponding beam-weighting factor set. Thus, by accessing the database with the inertial data that is generated by inertial sensor 18, a beam-weighting factor set is thereby provided.

After the beamforming weights are generated, beamformer 22 becomes operative to process the received signal voltages in accordance with the weights. Beamformer 22 includes a scaling facility for applying each weight to the received signal voltage provided by a respective antenna array element. More specifically, a complex valued weight (e.g., representing a gain and phase shift factor) is applied to the signal voltage that is output by each antenna element. In mathematical terms, this scaling facility corresponds to a product operation involving the multiplication of each voltage signal with the complex conjugate of its respective beamforming weight. The scaling may be implemented with a variable attenuator and phase shifter having an input gain factor corresponding to the beamforming weight. The weighted signals are combined by a linear summing device to generate an RF signal comprising the selected GPS signals. This RF signal is now available for detection by the host vehicle and will substantially include only the selected GPS transmissions and energy from any interference sources that lie within the array bandwidth of the high-gain beams. Any energy from other directions that is received by antenna array 10 will be sufficiently attenuated so as to render these interfering signals (e.g., RFI propagation) substantially non-detectable and thus incapable of interfering with the recovery of the GPS signals. Accordingly, the individual GPS signals are easily recoverable from the composite RF signal provided by beamformer 22.

Significantly, this attenuation and consequent rejection of the RFI is accomplished substantially independent of any knowledge of the location of the interfering sources. In particular, the beamforming weights that control the spatial directivity of the beamformer response do not reflect any indication of the origin or existence of jammers; rather, the weights simply represent the spatial identity of desired signal sources as determined by the GPS location data and inertially-sensed attitude.

The array algorithm processor of the present invention does not require any iterative procedure to converge upon optimum beamforming weights as is necessary in prior art systems. Instead, the array algorithm processor substantially instantly "converges" to the proper beamforming weights because it possesses information (i.e., the inertially-sensed attitude and source location data) that precisely defines the necessary spatial directivity of the beamformer response. Based on these weights, a beamformer response is immediately developed that maximizes gain in the direction of the satellites.

The absence of any convergence procedure, and the reliance upon GPS location data and the host vehicle attitude in developing a beamformer response, has significance for the present invention as it relates to the treatment of jammers vis-à-vis the prior art. The general approach of the prior art is to develop nulls, which represent low antenna gain, in the direction of jammers. As the number of jammers increases, the prior art systems respond by developing more nulls in these new jammer directions. However, with more nulls in the beamformer response, the depth of these nulls becomes shallower. As the radiation pattern flattens out, the gain level in the direction of the null increases such that the RFI is not suppressed. By contrast, in the present invention, it is not necessary to actively or knowingly place nulls in the direction of jammers nor even have any knowledge of the location of jammers. Instead, the beamformer response simply aims beams at the satellites, i.e., high-gain profiles are placed in the direction of transmission of the satellites. The result is to effectively suppress reception of radio propagation (e.g., RFI) outside this profile. By substantially dedicating the power available for signal reception to the formation of high-gain beams aimed in certain specified directions (i.e., towards GPS terminals), this ensures that very low antenna gain is available for the reception of energy in other directions (e.g., towards jammer sources), resulting in the rejection of RFI propagation. The directivity of the receiving pattern also inherently provides signal gain that permits lower-priced and less complex satellites to be used since the satellite transmissions themselves need not be highly directional nor of exceedingly high power.

The present invention also offers advantages over the prior art in accommodating changes in the attitude of the host vehicle. As noted above, vehicle movement and intelligent jamming impair the effectiveness of prior art convergence techniques. By contrast, the present invention is amenable to vehicle movement because the inertial sensor is continuously updating the array algorithm processor with information on the current attitude of the host vehicle, thereby providing with the GPS location data an indication of which satellites are within the current coverage area of the antenna array. Embedding the inertial sensor on the antenna groundplane allows inertial data to be available to the beamformer with negligible latency, thereby overcoming a deficiency of the prior art wherein vehicle inertial navigation data having up to hundreds of milliseconds of latency (i.e., delay) would be the only source of attitude information. This inertial information from the embedded inertial sensor allows the gain pattern of the beamformer response to be dynamically enhanced so that signal tracking is maintained. Additionally, since the array algorithm processor does not rely upon any knowledge of RFI sources, the present invention is virtually immune to intelligent jamming.

In accordance with another aspect of the present invention, the beamforming operation may also be used to identify the location of RFI sources, in contrast to the primary use described above concerning the acquisition of GPS transmissions. Since the GPS location data and inertially-sensed attitude provide an indication of the particular signal sources transmitting within the current coverage area, the beamforming weights can be designed so that the beamformer effectively scans in regions of the coverage area where no signal sources are transmitting. Thus, any energy detected in these scanned regions can be attributed to RFI sources, thereby identifying the location of any jammers. This jammer identity data can serve as a form of Electronic Support Measure (ESM) indicator useful to defense suppression forces in military applications. This information may also be used by the beamformer operation to add a further degree of optimization to the determination of beamforming weights, though it is not necessary to the proper functioning of the present invention. For example, knowledge of the directions from which interference sources emanate allows the operator to select the satellites which give the best combination of viewing geometry and measurement quality (e.g., signal-to-noise ratio) based on the high-gain antenna beams created to track individual satellites.

In accordance with yet another aspect of the present invention, a facility is provided to evaluate and maintain the accuracy of the attitude measurements obtained by the inertial sensor which is integrated with the antenna groundplane. In particular, the array algorithm is supplied with initialization data to initialize the attitude-sensing mechanism within the embedded inertial sensor. The importance of this calibration is evident since the inertial data constitutes an essential feature of the beamforming operation. The initialization data is preferably developed by a separate inertial sensing unit that forms part of a GPS navigation system installed on the host vehicle. Accordingly, the receiver system is preferably configured with a low speed data bus for accepting the initialization data from the host vehicle GPS navigation system. This data bus permits the receiver system to continually calibrate the embedded inertial sensors in order to correct for micromechanical inertial sensing errors, thereby compensating for sensor drift.

In accordance with yet another aspect of the present invention, a switching facility is provided to controllably and selectively determine which of the individual beams in the beamformer response are available for spatially filtering the received energy. For example, in the general case where all or a select group of the GPS satellite transmissions are to be received at the same time, the appropriate beams will be simultaneously generated by the beamformer and aimed in the necessary directions (i.e., aligned with the direction of propagation of the GPS signals). However, it may also be necessary for the receiver system to implement a form of temporal discrimination in which the GPS signals are acquired at different times. In order to accommodate this operational feature, the switching facility is provided in operative engagement with the beamformer to effectuate the selective formation of certain beams which correspond to the desired GPS satellite transmissions. The particular selections are continuously updatable and would preferably be supplied by the operator through an appropriate interface unit. Thus, the beam profile of the beamformer response may be dynamically adjustable using the switching facility.

Figure 3:
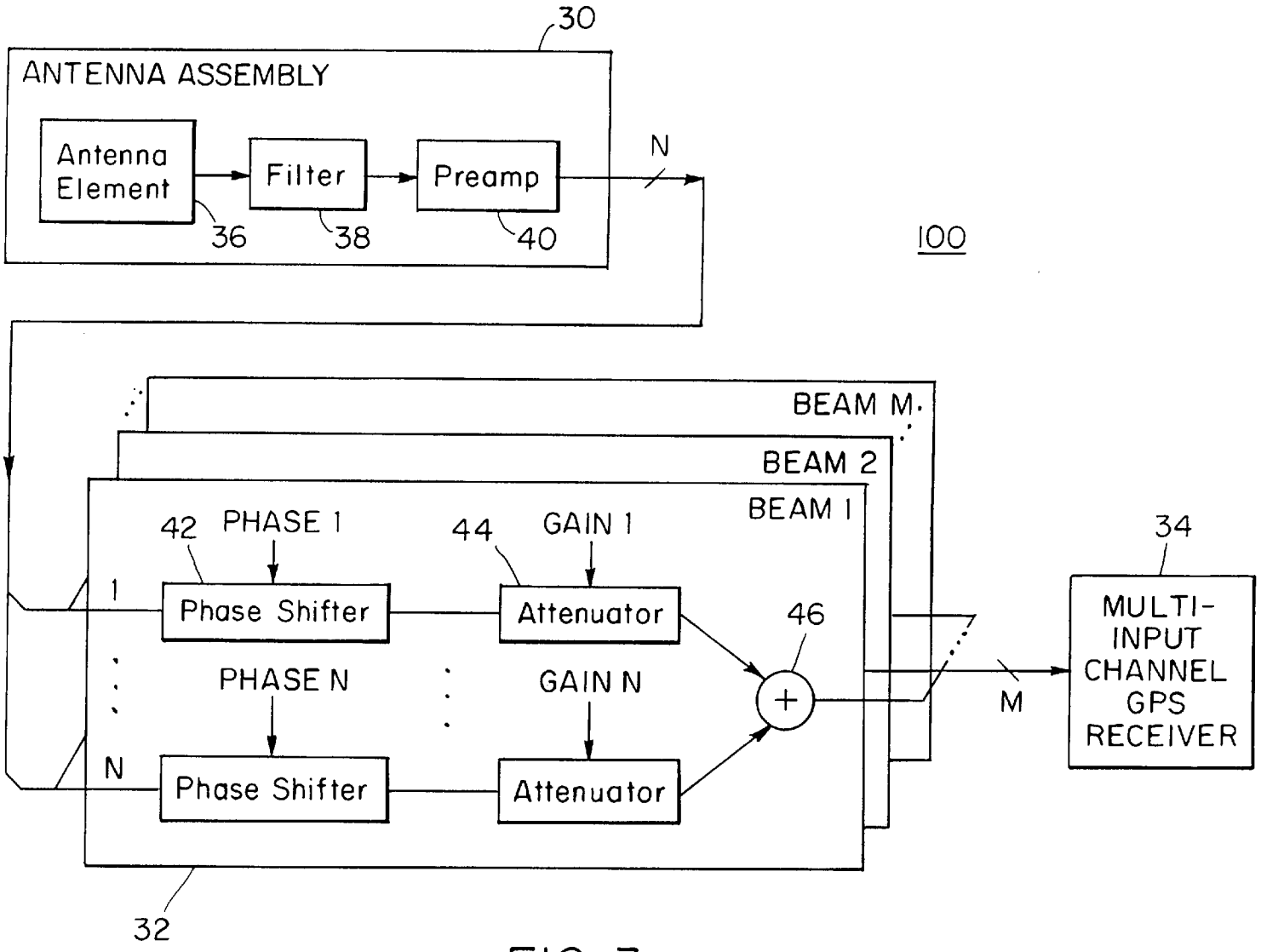
FIG. 3 is system block diagram of a receiver system capable of generating multiple beamformer responses in accordance with another embodiment of the present invention.

FIG. 3 is a system block diagram of a receiver system 100 in accordance with another embodiment of the present invention for simultaneously generating multiple beam patterns, each characterized by a respective beamformer response. The multiple beam patterns are formed by splitting the output of each antenna array element into multiple paths each dedicated to a respective beamforming apparatus having its own facility for generating beamforming weights.

The receiver system 100 includes an array of N antenna elements each configured within a representative antenna assembly 30, and further includes an array of M individual beamforming units 32. The receiver system is operative to receive energy transmissions with the array of N antenna elements and provide the received energy to the array of beamforming units 32. A branch circuit (not shown) is used to divide the output of each antenna assembly into a multiplicity of equivalent signals each available to a respective one of the beamforming units. Each beamforming unit is characterized by a respective beamformer response that defines the spatial filtering function which processes the received energy from the antenna array. The composite output is delivered to a multi-input channel GPS receiver 34.

The antenna assembly 30 includes an antenna element 36, a filter 38, and a preamplifier 40. The antenna element 36 receives electromagnetic energy propagating within a defined coverage area, and preferably is characterized by an hemispherial coverage profile. The received energy is applied to filter 38 to remove out-of-band spurious signals and other low level noise generated by the antenna receiving operation. The filtered signal is then applied to preamplifier 40 for amplifying the signal to a level suitable for processing by the beamforming units 32.

Each beamformer unit 32 is configured with a group of phase shifters 42, a group of attenuators 44, and a summing device 46. Although not shown, the array of antenna elements is distributed within an antenna groundplane in a configuration that preferably provides maximum physical area. Since the antenna elements are dispersed throughout the groundplane (in comparison to a co-located geometry), and hence have different spatial separations relative to the origins of transmission, the energy received by each antenna element will be phase-shifted relative to the energy from other antenna elements. Accordingly, in order to provide a coherent signal, the received energy from each antenna element is applied to a respective phase shifter 42 where the phase component is appropriately adjusted. The output of each phase shifter 42 is scaled by an attenuator 44 in accordance with an input gain factor. The attenuated signals are then combined by summing device 46 to provide a composite signal that is forwarded to the GPS receiver 34.

In general, each beamformer unit 32 functions similarly to the beamformer 22 shown in FIG. 1. As described above, beamformer 22 performs a beamforming operation that spatially filters the received energy from antenna array 10 in accordance with beam weights generated by array algorithm 20. The beam weights are generated using GPS location data and inertially-sensed data identifying the attitude of the receiver system. Referring to FIG. 3, the input gain factor for each attenuator 44 represents the particular beam weight that is generated for the corresponding received energy. Depending upon the choice of GPS units to be tracked, each beamformer unit 32 will be provided with a respective set of gain factors that determines which GPS transmissions will be received.

What has been shown and described herein is a novel receiver that facilitates the acquisition of certain signal sources without requiring any knowledge of the existence or location of jammers. The receiver also does not require a convergence procedure to acquire the desired signal transmissions, and avoids any post-detection processing (e.g., filtering) of RFI propagation. The beamformer in the receiver system generates beamforming weights using GPS location data and signals representative of the inertially-sensed attitude of the host vehicle. By generating beamforming weights in this manner, the resulting beamformer response is designed to have high-gain profiles in the direction of transmission of selected ones of the GPS terminals, thereby effectively suppressing any energy that propagates from directions other than those defined by the gain profiles.

In particular, the beamforming operation is effective in developing a beam pattern with high-gain profiles in only the directions of desired signal sources and with sufficiently low antenna gain in the remaining directions of the coverage area. With respect to the energy propagating along directions not substantially aligned with the directions of transmission of the desired signal sources, the beamformer response is designed to attenuate these non-aligned signals to a sufficiently low power level that effectively suppresses them. Consequently, the only detectable signals provided by the beamformer will be the received energy having transmission paths substantially aligned with the high-gain beams (i.e., from the desired signal sources).

Advantages of the present invention include the ability to dynamically change the beamforming weights in real-time as the host vehicle platform undergoes rotational and translational maneuvers. This capability is principally due to the near-instantaneous computation by the embedded inertial sensor of changes in the host vehicle attitude, allowing the beamformer to combine the current vehicle attitude with the computed locations of GPS satellites in order to optimize any desired performance index with the proper setting of antenna beamforming weights. The precision of the inertial sensor and its responsiveness to attitude changes virtually prevent any latency in supplying accurate attitude information to the receiver system.

Additionally, the required inertial sensing data (i.e., the attitude value for the antenna array) is determined independent of any further processing or any other positional input (e.g., from the host vehicle or ground station). This independence is due to the co-location of the micromechanical inertial sensors and the antenna array elements within an integral structure, thus facilitating a determination of the attitude value with a single calculational task. By contrast, in conventional systems where the attitude value may be used in computing beamforming weights, the attitude value is computed using inertial sensing calculations provided by the host vehicle's inertial sensors and a relative measurement of the position of the antenna array with respect to the host vehicle's inertial sensors (i.e., a "lever-arm" offset). The placement of inertial sensors within the antenna groundplane in accordance with the present invention thus eliminates the need for determining any "lever-arm" offsets between the antenna groundplane and the inertial sensors of the host vehicle's GPS navigation system.

Further benefits may be possible if the present invention takes advantage of progress being made in the area of hardware miniaturization, specifically as it relates to the reduction in dimensions of antenna elements without compromising the precision necessary for the beamforming operation. Miniaturization of antenna array elements enhances the possibility that small incursions into the aircraft skin can be made over a region large enough to provide suitable antenna directivity, creating a distribution of such miniature array elements that supports the formation of narrow angular beamwidths.

Therefore, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A system for receiving signals transmitted from a plurality of signal sources at locations identified by source location data, said system comprising:

receiver means for receiving energy propagations;

attitude determination means for determining an attitude of said receiver means relative to said locations of said signal sources; and beamforming means, coupled to said receiver means and said attitude determination means, for generating a gain profile derived from said source location data and said attitude of said receiver means, and for applying said gain profile to said received energy propagations thereby establishing selective gain for energy propagations received in the direction of said signal sources.

2. The system as recited in claim 1, further comprising support means for integrally supporting said receiver means and said attitude determination means.

3. The system as recited in claim 1, wherein said beamforming means comprises filtering means for spatially filtering said received energy in accordance with a beamformer response having a gain profile defined by said source location data and the determined attitude of said receiver means.

4. The system as recited in claim 1, wherein said receiver means comprises a plurality of antenna elements.

5. The system as recited in claim 4, wherein said attitude determination means comprises inertial sensing means for generating signals representative of an inertially-sensed attitude of said receiver means.

6. The system as recited in claim 5, further comprising an antenna platform for integrally supporting said plurality of antenna elements and said inertial sensing means.

7. The system as recited in claim 4, wherein said beamforming means comprises:

analysis means, responsive to said source location data and coupled to said attitude determination means, for generating beam-weighting data that embodies a representation of said source location data and the determined attitude of said receiver means and which is suitable for weighting the energy received by said receiver means; and a beamformer unit, coupled to said receiver means and responsive to said beam-weighting data, for combining the received energy using said beam-weighting data.

8. The system as recited in claim 7, wherein said analysis means comprises weight generation means for generating a weight factor for each antenna element that is based on said source location data and the determined attitude of said receiver means.

9. The system as recited in claim 8, wherein said beamformer unit comprises:

scaling means, coupled to said weight generation means, for applying each weight factor to the received energy of said respective antenna element; and combining means for linearly combining said received energy as weighted by said scaling means.

10. The system as recited in claim 9, wherein a response of said beamformer unit is characterized substantially by a high-gain beam in each direction of transmission of ones of said signal sources.

11. The system as recited in claim 10, further comprising output means, operatively coupled to said beamforming means, for adapting said beamformer response such that said high-gain beams are formed substantially simultaneously.

12. The system as recited in claim 10, further comprising beam switching means, operatively coupled to said beamforming means and responsive to switching data representative of selected signal sources, for switchably receiving the transmissions of selected ones of said signal sources in accordance with said switching data.

13. The system as recited in claim 1, wherein said energy propagations include electromagnetic energy.

14. The system as recited in claim 13, wherein said electromagnetic energy includes radiowave propagation.

15. The system as recited in claim 1, wherein said energy propagations include acoustic energy.

16. The system of claim 1 wherein said beamforming means applies said gain profile to said energy propagations for selectively establishing high gain for energy propagations received in the direction of said signal sources and for effective attenuation of energy propagations received from other directions.

17. A system affixed to a mobile host vehicle for receiving transmissions from a plurality of signal sources, said system comprising:

means for determining the location of said plurality of signal sources;

antenna means for receiving energy transmissions;

inertial sensing means for inertially sensing the attitude of said mobile host vehicle;

beam weighting means for determining a beam-weighting factor set, based on said inertially-sensed attitude and said signal source locations, that defines a spatial filtering function; and beamforming means, operably coupled to said antenna means and said beam weighting means, for spatially filtering the transmissions received by said antenna means in accordance with said beam weighting factor set.

18. The antenna system as recited in claim 17, further comprising support means for integrally supporting said antenna means and said inertial sensing means.

19. The antenna system as recited in claim 16, wherein said antenna means comprises an antenna array including a plurality of antenna elements.

20. The antenna system as recited in claim 17, wherein said beamforming means comprises combining means for linearly combining the transmissions received by said antenna means in accordance with said beam weighting factor set.

21. The antenna system as recited in claim 17, wherein said inertial sensing means comprises a micromechanical inertial sensor integrally embedded in an antenna groundplane that supports said antenna means.

22. The antenna system as recited in claim 17, wherein said beam weighting means comprises:

database means including data representative of a plurality of host vehicle attitude values each indexed to a corresponding beam weighting factor set; and retrieval means, coupled to said database means and responsive to said inertially sensed attitude, for providing the beam weighting factor set from said database means corresponding to said inertially sensed attitude.

23. The antenna system as recited in claim 17, further comprising navigation means for continually calibrating said inertial sensing means to compensate for drift errors.

24. The system as recited in claim 17, wherein said spatial filtering function is characterized by high-gain profiles in the direction of transmission of ones of said signal sources whose transmissions were received by said antenna means.

25. A system resident on a host vehicle platform for receiving energy transmissions, said system comprising:

location means for providing the locations of a plurality of signal sources;

antenna means for receiving energy transmissions;

inertial sensor means for generating an inertial sensing signal representative of the attitude of said host vehicle platform;

analysis means, responsive to said inertial sensing signal and the locations of said signal sources, for generating a beam weighting factor set representative of a spatially-discriminatory filtering operation that favors the reception of transmissions from ones of said signal sources; and beamforming means, operably coupled to said antenna means and said analysis means, for applying said beam weighting factor set to said received transmissions, thereby establishing selective gain for transmissions received in the direction of said signal sources.

26. The system as recited in claim 25, further comprising support means for integrally supporting said antenna means and said inertial sensor means.

* * * * *